US006039920A

United States Patent [19]

Koch et al.

[11] Patent Number: 6,039,920

[45] Date of Patent: Mar. 21, 2000

[54] PROCESS FOR MAKING RHENIUM-CONTAINING ALLOYS

[75] Inventors: Michael Koch, Bruchköbel; Wulf Kock, Alzenau; David Francis Lupton, Gelnhausen; Friedhold Scholz, Rodenbach, all of Germany

[73] Assignee: W. C. Heraeus GmbH & Co. KG, Hanau, Germany

[21] Appl. No.: 09/072,381

[22] Filed: May 4, 1998

[30] Foreign Application Priority Data

May 12, 1997 [DE] Germany ..... 197 19 407
Mar. 18, 1998 [DE] Germany ..... 198 11 765

[51] Int. Cl.[7] ..... C22C 1/03

[52] U.S. Cl. ..... 420/590; 420/83; 420/433; 420/455; 420/435; 420/440; 420/129

[58] Field of Search ..... 420/83, 433, 455, 420/435, 440, 129, 590

[56] References Cited

U.S. PATENT DOCUMENTS 4,119,458 10/1978 Moore .

FOREIGN PATENT DOCUMENTS 554198 8/1993 European Pat. Off. .
729862 10/1943 Germany .
2530245 1/1976 Germany .
52-52106 4/1977 Japan .
1195740 6/1970 United Kingdom .

OTHER PUBLICATIONS

Lazareno, V.V., Parishin, A.P., Shatalov, V.V., "Rhenium Based Alloy Agent Containing Molybdenum, Nickel Aluminum Increase Ingot Yield Assimilate Rhenium Produce Refractory Nickel", May 27, 1996, *Derwent Abstract* of SU 1 804 141, AN 97–064178.

Barmin, Yu. V., Obintsev, Yu A., Zolotukhin, I.V., "Amorphus Binary Alloy Containing Rhenium and Iron is Melted Using Ion Plasma Sputtering in High Purity Argon Atmosphere and Has Improved Thermal Stability", Jun. 15, 1993, *Derwent Abstract* of SU 1 464 500, AN 94–309220.

*Primary Examiner*—Deborah Yee
*Attorney, Agent, or Firm*—Frishauf, Holtz, Goodman, Langer & Chick, P.C.

[57] ABSTRACT

A process for making iron, cobalt and/or nickel base alloys containing rhenium. The process involves melting together the components that form the alloys, at least one of the components being a rhenium master alloy having 30 to 70 wt % rhenium, then casting the resultant melt and allowing the melt to solidify. Possible difficulties such as the formation of rhenium heptoxide are avoided by using a master alloy containing (i) rhenium and (ii) iron, cobalt and/or nickel, instead of sintered rhenium as the rhenium source during the melting step.

15 Claims, No Drawings

PROCESS FOR MAKING RHENIUM-CONTAINING ALLOYS

BACKGROUND OF THE INVENTION

1. Field of the Invention

The present invention relates to a process for making rhenium-containing alloys by melting together the constituents that form the alloys, then casting the melt and allowing the melt to solidify. The present invention also concerns rhenium-containing alloys made according to such process.

The present invention relates, in particular, to a process for making an iron, cobalt or nickel base alloy, or an alloy containing a mixture of at least two of these base metals, wherein such alloy further contains rhenium; and the present invention is directed to an alloy made according to this process.

2. Background Information

In the context of the present specification, an iron, cobalt or nickel base alloy and an alloy containing a mixture of at least two of these base metals, wherein such alloy further contains rhenium, are understood to be alloys whose content of iron, cobalt and/or nickel is higher than that of rhenium and of any other constituent that may also be present in the alloys.

The superalloys, among other materials, belong to this category of alloys. According to *Römpp Chemical Encyclopedia,* 9th Edition, Stuttgart; New York; Georg Thieme Verlag, 1989 to 19921, 4393, these alloys have an extremely complex composition for use at very high temperatures. The base metal of the alloy is iron, nickel or cobalt, with admixtures of metals (cobalt, nickel, iron, chromium, molybdenum, tungsten, tantalum, niobium, aluminum, titanium, manganese and/or zirconium) and nonmetals (carbon and boron). Parts and components of superalloys are made by forming, casting or sintering, and derive their special properties from the precipitation or reaction kinetics of the elements involved, as a function of the manufacturing process and the applied temperature. Superalloys are used in the construction of engines and propulsion units, and are utilized in the fields of energy engineering and aerospace.

The choice of admixtures of elements is guided by the stresses and strains to which the superalloys are exposed during operation. For example, in DE 25 30 245 there is described a high-temperature-resisting, corrosion-resistant and oxidation-resistant superalloy which contains at least 50 vol % γ'-phase and can comprise 14.3 wt % chromium, 13.5 wt % cobalt, 2.1 wt % titanium, 1.8 wt % aluminum, 9.2 wt % platinum and the rest nickel.

Superalloys for jet propulsion units may contain an admixture of metals including rhenium (*Römpp Chemical Encyclopedia,* 9th Edition, Stuttgart; New York; Georg Thieme Verlag, 1989 to 1992, 3867). Superalloys of this type comprise, for example, 10% cobalt, 8.7% tantalum, 5.9% tungsten, 5.7% aluminum, 5% chromium, 3% rhenium, 1.9% molybdenum, 0.1% hafnium and the rest nickel (EP 0 554 198) or 2% chromium, 3.7% cobalt, 32% molybdenum, 8.2% tantalum, 6.2% aluminum, 6.3% rhenium, 4% vanadium, 0.24% carbon and the rest nickel (*Ullmann's Encyclopedia of Industrial Chemistry,* 5th Edition, Weinheim; VCH Verlagsgesellschaft mbH, 1985 to 1995, Volume A13, 61).

Alloys of iron, cobalt and nickel, which contain rhenium, are known. In German Patent 729 862, for example, there is described a material for making corrosion-resistant, naturally hard and abrasion-resistant articles of rhenium or of high-rhenium alloy containing admixtures of platinum metals, tungsten, chromium, molybdenum, iron, cobalt and nickel individually or in combination, in a proportion of 0.1 to 50%. In JP 52-52106, there is described an electrodeposited alloy of rhenium and cobalt or nickel for electrical contacts.

To make iron, cobalt and/or nickel base alloys containing rhenium, by melting together the constituents forming the alloys, and then casting the melt and allowing the melt to solidify, melts (premelts) are usually formed first from the main constituents in a vacuum induction-melting furnace. Then the admixtures are introduced into the melt, wherein the rhenium is used in the form of pellets obtained from rhenium powder by pressing and sintering (in a vacuum, or under a reducing atmosphere, usually hydrogen).

Because of some characteristic properties of rhenium, this manufacturing process is complex and is associated with problems that may impair the quality of the alloys.

The high melting point (3180° C.) of rhenium, approximately 1700° C. above that of the melt, and its high density (21.0 g/cm$^3$; melt: about 8 g/cm$^3$) make it difficult to melt rhenium and distribute it homogeneously in the melt.

Since rhenium is easily oxidized to rhenium heptoxide, $Re_2O_7$, by atmospheric oxygen, any oxygen that, for example, still remains in the melt, despite thorough outgassing or is still present in the atmosphere of the melting furnace, may lead to the formation of rhenium heptoxide. Rhenium heptoxide sublimes at 250° C. and above, so that the melt is undesirably depleted of rhenium and the alloys no longer satisfy the desired specifications for the same.

SUMMARY OF THE INVENTION

An object of the present invention is therefore to provide a process for making an iron, cobalt or nickel base alloy, or an alloy containing a mixture of at least two of these base metals, wherein the alloy further contains rhenium, by melting together the constituents forming the alloy, casting the melt and allowing the melt to solidify. This process avoids the disadvantages of the known process.

The process of the present invention is advantageous in that it is simple to perform and will lead to alloys of good and consistent quality and constant composition. It is particularly advantageous that rhenium-containing superalloys, especially nickel base rhenium-containing superalloys, can be made according to the process of the present invention.

The present invention concerns a process for making an alloy, especially a superalloy, containing rhenium comprising (a) melting together the components that form the alloy, at least one of the components being a rhenium master alloy produced by melting, the rhenium master alloy comprising rhenium in an amount of 30 to 70 wt %;

(b) casting the resultant melt from step (a); and (c) allowing the melt to solidify.

The process representing the achievement of the above object is thus characterized according to the present invention by the fact that, in the melting-together step, the rhenium constituent is used in the form of a rhenium alloy having a rhenium content of 30 to 70 wt %, and also containing at least one metal selected from the group consisting of iron, cobalt and nickel, obtained by fusion metallurgy, i.e., melting.

DETAILED DESCRIPTION OF THE INVENTION

The rhenium alloy used for the process according to the present invention represents a so-called "master alloy".

According to *Römpp Chemical Encyclopedia,* 9th Edition, Stuttgart; New York; Georg Thieme Verlag, 1989 to 1992, 2478, "master alloys" are alloys used in metallurgy.

The process according to the present invention has proved successful when there is used as the "master alloy" a rhenium-iron alloy comprising 30 to 70 wt % rhenium and 30 to 70 wt % iron, preferably 50 wt % rhenium and 50 wt % iron, or a rhenium-cobalt alloy comprising 30 to 70 wt % rhenium and 30 to 70 wt % cobalt, preferably 50 wt % rhenium and 50 wt % cobalt, obtained by fusion metallurgy, i.e., melting.

The process according to the present invention has proved to be particularly favorable when there is used as the "master alloy" a rhenium-nickel alloy comprising 30 to 70 wt % rhenium and 30 to 70 wt % nickel, preferably 50 wt % rhenium and 50 wt % nickel, obtained by fusion metallurgy, i.e., melting.

The rhenium-containing master alloy utilized in the present invention is obtained by fusion metallurgy, i.e., melting, in order to avoid oxidation in a vacuum or in the presence of a shielding gas. The melting is preferably carried out in a crucible. Suitable materials for the melting crucible are graphite, alumina, silica or zirconia.

A rhenium-iron, rhenium-cobalt and rhenium-nickel master alloy is advantageously used in the form of granules, which can be obtained by pouring the molten master alloy into water. Such granules have good handling and metering characteristics. Granules with a size of about 1 to 3 millimeters have proved particularly suitable for this purpose.

Compared with the known process discussed herein, the process according to the present invention is characterized by its simpler feasibility. The rhenium-containing alloys made according to the process of the present invention exhibit very good quality and high purity. The process of the present invention is used preferably for providing nickel base alloys containing rhenium.

The rhenium-containing alloy used as the master alloy in the process according to the present invention melts in a temperature range (solidus temperature in the range from about 1550° C. to 1750° C.) below the melting point of rhenium. Thus it melts very much more easily in the premelt, which has a temperature of about 1500 to 1600° C. and a density of about 8 g/cm$^3$, than does the sintered rhenium used in the known process.

The lower density of the rhenium-containing master alloy favors homogeneous distribution thereof in the melt; settling at the bottom of the melting crucible is thus not a concern. Furthermore, the rhenium-containing master alloy does not have the same reactivity towards oxygen as does sintered rhenium pellets, and so the danger of formation of rhenium heptoxide followed by depletion of rhenium from the melt does not exist.

A rhenium-nickel alloy with a solidus temperature of 1620° C. is preferably used as a master alloy for the process of the present invention. This master alloy can be made by melting nickel and rhenium in a vacuum or in the presence of at least one gas such as argon, carbon monoxide or hydrogen as a "shielding gas", i.e., a non-oxidizing atmosphere with respect the rhenium-containing melt; the rhenium being obtained in a known way from ammonium perrhenate by reduction in a stream of hydrogen. As discussed above, graphite, alumina, silica and zirconia are suitable as materials for the melting crucible. Alumina or silica has proved particularly successful as a crucible material, and argon or carbon monoxide is particularly preferred as a shielding gas for melting an alloy comprising 50 wt % rhenium and 50 wt % nickel, which has a density of about 15 g/cm$^3$.

By pouring the molten rhenium-nickel alloy into water, there can be obtained granules with advantageous mechanical strength and good metering and handling characteristics.

Rhenium with a purity of higher than 99.99% can be obtained from ammonium perrhenate. Nickel is generally used in commercial quality with a purity of 99.97%. If nickel-base superalloys of aviation grade are to be made, high-purity nickel, as can be obtained by the carbonyl process, for example, or in other words by thermal decomposition of nickel tetracarbonyl, is selected for production of the rhenium-nickel master alloy.

Optionally the rhenium master alloy which comprises rhenium and at least one metal selected from the group consisting of iron, cobalt and nickel, such as rhenium and iron, or rhenium and cobalt, or rhenium and nickel, additionally can contain an element or elements which will be a component of the superalloy prepared by the process of the present invention. Such additional element or elements include metals such as chromium, molybdenum, tungsten, tantalum, niobium, aluminum, titanium, manganese and zirconium; and non metals such as carbon and boron.

The present invention will now be described with reference to the following non-limiting Examples relating to the preparation of a master alloy of 50 wt % rhenium and 50 wt % nickel and 40 wt % rhenium and 60 wt % nickel respectively.

EXAMPLES 1 AND 2

Materials used in the Examples: Ammonium perrhenate was reduced to metallic rhenium powder by treatment under a stream of hydrogen at 950° C. An analysis showed the purity of the rhenium to be approximately 99.995%.

The nickel used had been produced by the carbonyl process and was a grade typically used in the manufacture of nickel base alloys for aircraft gas turbine blades.

EXAMPLE 1

500 g of rhenium powder and 500 g of nickel powder were placed in a silica crucible and heated under an atmosphere of carbon monoxide in a medium-frequency (4000 Hz) induction melting furnace. After the nickel started to melt (1455° C.), the temperature of the melt was raised steadily until no more solid phase could be observed. The melt was held for 2 minutes to ensure homogenization and then poured slowly into a large bath of cold water where it solidified to a granulate with a grain size of approximately 1.5 mm. The oxygen content of the granules was determined by fusion extraction to be 370 ppm.

EXAMPLE 2

400 g of rhenium powder and 600 g of nickel powder were placed in an alumina crucible and heated as described in Example 1, but under an atmosphere of 95 vol. % argon+5 vol. % hydrogen. After melting and granulating the alloy, the oxygen content was determined to be 230 ppm.

It will be appreciated that the instant specification is set forth by way of illustration and not limitation, and that various modifications and changes may be made without departing from the spirit and scope of the present invention.

What is claimed is:

1. A process for making an alloy containing rhenium comprising (a) melting together the components that form the alloy, at least one of the components being a rhenium master alloy produced by melting, the rhenium master alloy comprising rhenium in an amount of 30 to 70 wt % and 30 to 70 wt % of at least one metal selected from the group consisting of iron, cobalt and nickel;

(b) casting the resultant melt from step (a); and (c) allowing the melt to solidify.

2. A process for making an alloy containing rhenium comprising (a) melting together the components that form the alloy, at least one of the components being a rhenium master alloy produced by melting, the rhenium master alloy being a rhenium-iron alloy comprising 30 to 70 wt % rhenium and 30 to 70 wt % iron, (b) casting the resultant melt from step (a); and (c) allowing the melt to solidify.

3. The process according to claim 2, wherein the rhenium master alloy in step (a) comprising 50 wt % rhenium and 50 wt % iron.

4. The process according to claim 1, wherein the rhenium master alloy in step (a) is a rhenium-cobalt alloy comprising 30 to 70 wt % rhenium and 30 to 70 wt % cobalt.

5. The process according to claim 4, wherein the rhenium master alloy in step (a) is a rhenium-cobalt alloy comprising 50 wt % rhenium and 50 wt % cobalt.

6. The process according to claim 1, wherein the rhenium master alloy in step (a) is a rhenium-nickel alloy comprising 30 to 70 wt % rhenium and 30 to 70 wt % nickel.

7. The process according to claim 6, wherein the rhenium master alloy in step (a) is a rhenium-nickel alloy comprising 50 wt % rhenium and 50 wt % nickel.

8. The process according to claim 1, wherein the rhenium master alloy is in the form of granules.

9. The process according to claim 8, wherein the granules have a size of 1 to 3 millimeters.

10. The process according to claim 1, wherein the rhenium master alloy is obtained by melting in a vacuum.

11. The process according to claim 1, wherein the rhenium master alloy is obtained by melting in the presence of at least one gas selected from the group consisting of argon, carbon monoxide and hydrogen.

12. The process according to claim 1, wherein the rhenium master alloy is obtained by melting in a crucible of graphite, alumina, silica or zirconia.

13. The process according to claim 1, wherein the rhenium master alloy melts in a temperature range of 1550 to 1750° C.

14. The process according to claim 2, wherein the rhenium master alloy is in the form of granules having a size of 1 to 3 millimeters.

15. The process according to claim 2, wherein the rhenium master alloy is obtained by melting in a vacuum and in the presence of at least one gas selected from the group consisting of argon, carbon monoxide and hydrogen.

* * * * *